US010524572B2

(12) United States Patent
Lercher

(10) Patent No.: US 10,524,572 B2
(45) Date of Patent: Jan. 7, 2020

(54) COOLING AND/OR FREEZER

(71) Applicant: Liebherr-Hausgerate Lienz GmbH, Lienz (AT)

(72) Inventor: Dominik Lercher, Nikolsdorf (AT)

(73) Assignee: LIEBHERR-HAUSGERÄTE LIENZ GMBH, Lienz (AT)

( * ) Notice: Subject to any disclaimer, the term of this patent is extended or adjusted under 35 U.S.C. 154(b) by 0 days.

(21) Appl. No.: 15/674,808

(22) Filed: Aug. 11, 2017

(65) Prior Publication Data

US 2018/0049548 A1 Feb. 22, 2018

(30) Foreign Application Priority Data

Aug. 18, 2016 (DE) ..... 10 2016 010 005

(51) Int. Cl.

| | |
|---|---|
| ***A47B 97/00*** | (2006.01) |
| ***A47B 91/00*** | (2006.01) |
| ***A47B 91/02*** | (2006.01) |
| ***A47B 91/06*** | (2006.01) |
| ***F25D 11/00*** | (2006.01) |
| ***F25D 23/00*** | (2006.01) |

(52) U.S. Cl.

CPC ..... *A47B 97/00* (2013.01); *A47B 91/005* (2013.01); *A47B 91/024* (2013.01); *A47B 91/06* (2013.01); *F25D 11/00* (2013.01); *F25D 23/00* (2013.01); *A47B 2097/008* (2013.01); *F25D 2323/0011* (2013.01); *F25D 2400/38* (2013.01)

(58) Field of Classification Search

CPC ..... A47B 97/00; A47B 91/024; A47B 91/06; A47B 2097/008; F25D 11/00; F25D 23/00; F25D 2323/0011; F25D 2400/38

See application file for complete search history.

(56) References Cited

U.S. PATENT DOCUMENTS 3,150,904 A * 9/1964 Kendt ..... A47L 15/427 126/191
3,150,905 A * 9/1964 Payton ..... A47B 91/16 126/191
4,836,624 A * 6/1989 Schwickrath ..... A47B 97/00 211/4
4,890,813 A * 1/1990 Johnson ..... A47B 97/00 248/500
4,932,729 A * 6/1990 Thompson ..... A47B 91/002 16/19
4,955,569 A * 9/1990 Hottmann ..... F16M 7/00 248/188.2
4,991,805 A * 2/1991 Solak ..... F16M 7/00 248/188.4
5,131,617 A * 7/1992 McGarrah ..... G07F 9/10 248/500
5,176,437 A * 1/1993 Remington ..... A47B 91/08 248/500

(Continued)

*Primary Examiner* — Hanh V Tran

(74) *Attorney, Agent, or Firm* — Kilyk & Bowersox, P.L.L.C.

(57) ABSTRACT

The present invention relates to a refrigerator unit and/or freezer unit having a unit carcass and a unit door that is pivotable about an axis, preferably about a vertical axis, and that closes the cooled inner space at the front side, wherein removable protection against tilting is attached to the unit body and at least extends the tilt point of the unit body to the front and/or to the side beyond the normal footprint of the body.

6 Claims, 8 Drawing Sheets

(56) References Cited

Figure 1A:
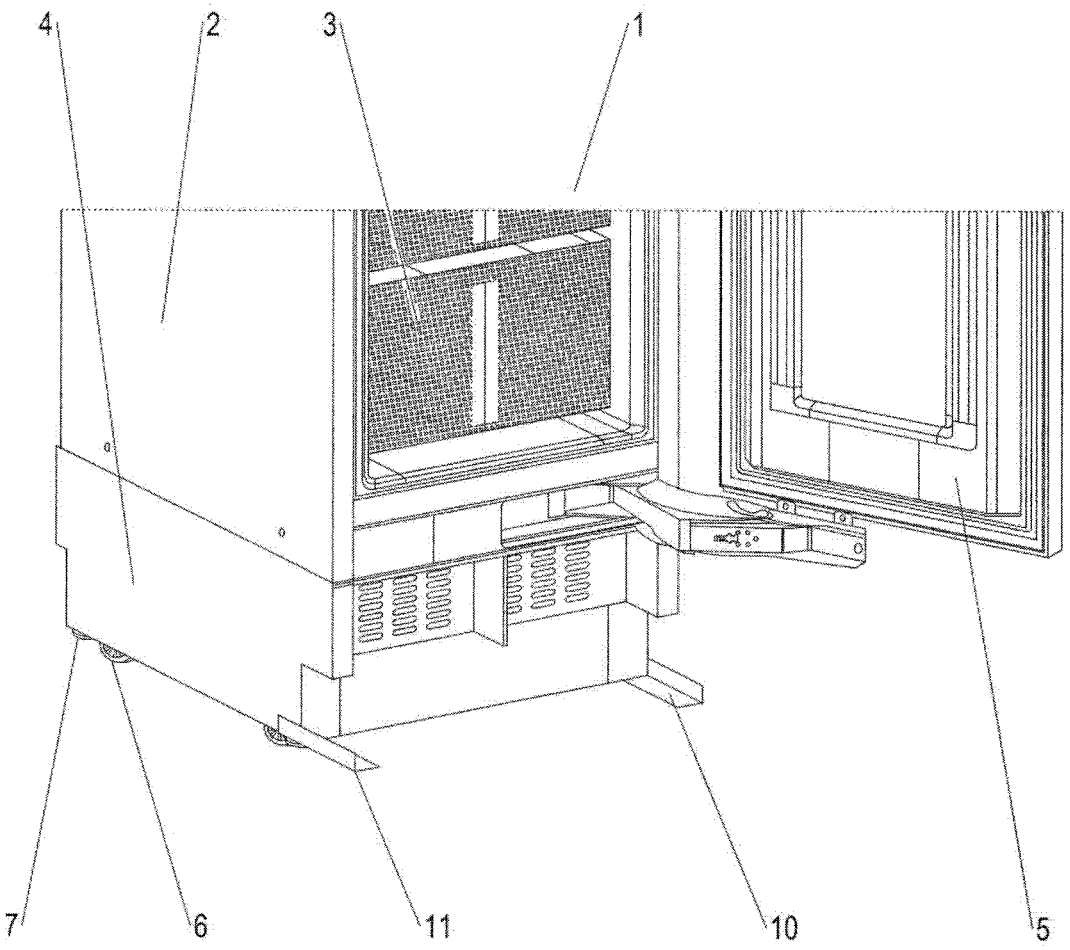

U.S. PATENT DOCUMENTS 5,624,098 A * 4/1997 McDowell ..... F24C 3/12 248/188.8
6,857,711 B1 * 2/2005 Straus ..... A47B 45/00 312/205
8,152,253 B2 * 4/2012 Yu ..... A47B 97/00 312/349
8,386,074 B2 * 2/2013 Smith, III ..... G07F 9/006 221/96
8,985,345 B2 * 3/2015 Fan ..... H05K 7/18 211/26
9,532,650 B2 * 1/2017 Barnett ..... A47B 97/00
9,955,608 B2 * 4/2018 Davis ..... H05K 7/1488
2004/0174105 A1 * 9/2004 Hung ..... A47B 91/02 312/351.1
2009/0001246 A1 * 1/2009 Phillips ..... A47L 15/4253 248/680
2009/0218471 A1 * 9/2009 Kempte ..... A47B 77/02 248/500
2012/0013092 A1 * 1/2012 Fan ..... H05K 7/1488 280/79.3
2013/0180187 A1 * 7/2013 Takeshita ..... E04B 1/98 52/167.8
2013/0307397 A1 * 11/2013 Adams ..... A47B 91/02 312/351.3
2014/0263925 A1 * 9/2014 Essrig ..... A47B 97/00 248/505
2014/0367402 A1 * 12/2014 Jin ..... G07F 11/16 221/9
2015/0130337 A1 * 5/2015 Doerflinger ..... A47B 31/00 312/249.11
2015/0130339 A1 * 5/2015 Barnett ..... A47B 97/00 312/319.1
2015/0130342 A1 * 5/2015 Barnett ..... A47B 97/00 312/351.1
2017/0273212 A1 * 9/2017 Davis ..... H05K 7/18

* cited by examiner

COOLING AND/OR FREEZER

The invention relates to a refrigerator unit and/or freezer unit having a unit body and having a unit door that is pivotable about an axis, preferably about a vertical axis, and that closes the cooled inner space at the front side.

On a movement of refrigerator units and/or freezer units during production, on the transport of the units or on the setting up or installation of the units at the customer's, a tilting of the unit can occur due to a displacement of the center of gravity that can be caused by an opening of the door. This in particular applies to unit types such as built-in units that are not designed to stand in a stable and free-standing manner.

Units are currently fastened to a pallet or secured by wedges to prevent tilting. This kind of security against tilting is, however, unpractical and above all has to be removed before an installation of the unit. There is thus the risk that the unit will tilt on an opening of the door, at least during installation.

It is the object of the invention to provide a security against tilting that can be arranged at the unit in a simple manner and can preferably not be removed until the unit is secured at its end position.

Against this background, the invention relates to a refrigerator unit and/or a freezer unit having a unit carcass and a unit door that is pivotable about an axis, preferably about a vertical axis, and that closes the cooled inner space at the front side, wherein a removable protection against tilting is attached to the unit body and at least extends the tilt point of the unit body to the front and/or to the side beyond the normal footprint of the body.

The normal footprint of the body is understood as the footprint with no protection against tilting. It is defined by the connection lines of the parts of the unsecured body free of protection against tilting that contact the floor.

The protection against tilting is a body contacting the floor or extending close to the floor. The frontmost point of the protection against tilting projects at least beyond the normal footprint of the body toward the front. It can thus be achieved that with an attached protection against tilting the normal footprint of the body or the tilting point is extended toward the front, i.e. in the direction of the door.

It can thus be prevented that the body tilts to the front on a transfer of the weight to the front, for example due to an opening of the door.

The protection against tilting is preferably in place during the production of the unit in order already to prevent a tilting of the unit during the production process.

In an embodiment, the unit body has rollers that at least partly define the normal footprint of the body. For example, the unit body can have four rollers, namely two front rollers and two rear rollers, that define the normal footprint.

Alternatively or additionally, the unit body can have feet that at least partly define the normal footprint of the body. The unit body can also have adjustable feet, for example four adjustable feet, here, namely two front adjustable feet and two rear adjustable feet, that define the normal footprint.

In an embodiment, the adjustable feet comprise a platform whose spacing from the bottom of the unit body can be changed. Provision can, for example, be made that the platform is connected to the bottom of the unit body by means of a threaded bar and that the spacing of the platform from the unit bottom can be changed by rotating the adjustable foot.

In an embodiment, the protection against tilting can be attached to the unit body without tools. Provision can, for example, be made that the protection against tilting is clamped, latched or plugged to the unit body. In an embodiment, the protection against tilting is clamped between the platform of the adjustable feet and the bottom of the unit body.

Provision can be made that the body has both rollers and adjustable feet, with the rollers at least partly defining the footprint of the unit in the unsecured state. The adjustable feet can be extended at the installation site of the unit. The position of the unit is secured in this respect and the protection against tilting is simultaneously released. It can thus be ensured that the unit never stands in an unsecured manner.

The protection against tilting can be formed in multiple parts or as a single part. A multipart design is preferred.

In an embodiment, the protection against tilting is a rail that extends to the front starting from the normal footprint of the body. An L-shaped section rail is preferred, for example. The rail can preferably extend to the front in a straight manner.

Exactly two rails can, for example, be provided as a protection against tilting; they are clamped between the platforms of left and right front adjustable feet and the bottom of the unit body and preferably extend to the front in a straight manner starting from this.

In an embodiment, the extended footprint of the body at least extends up to and into the plane of the unit opening. In an embodiment, the extended footprint of the body even at least extends up to and into the frontal plane of the closed door.

The extended footprint designates the footprint of the secured unit with an attached protection against tilting. It is larger than the normal footprint and at least projects beyond it to the front.

In an embodiment, the refrigerator unit and/or a freezer unit is a built-in unit. Such units often do not stand in a stable manner in the non-built in state such that even a rather small displacement of the center of gravity caused by opening could already have the consequence of a tilting of the body.

Against the already named background, the invention furthermore relates to a method of installing a refrigerator unit and/or a freezer unit in accordance with the invention, wherein the unit is fixed at the installation side and the protection against tilting is subsequently removed. The unit thus remains in the secured state until it is fixed at the installation site. Provision can, for example, be made that adjustable feet are moved out at the installation site of the unit and the protection against tilting released in this process is removed. A tilting of the unit on, for example, an unwanted opening of the door, can therefore be prevented in all cases.

Further details and advantages result from the following embodiment described with reference to the Figures. The Figures show:

FIGS. 1A-1D: a refrigerator and freezer unit in accordance with the invention with protection against tilting; and FIGS. 2A-2D: the corresponding unit in its end position without protection against tilting.

The unit shown in the Figures is generally marked by the reference numeral 1. It is a built-in refrigerator unit, i.e. a unit that is to be placed in an installation niche of a kitchen and is to be secured there.

It comprises a body 2 that surrounds a cooled inner space 3. The body 2 furthermore has a base 4 beneath the cooled inner space 3 and the machine space and the ventilation apparatus among others are located therein. A door leaf 5 to close the inner space 3 is connected in an articulated manner in front of the front-side opening of the inner space 3 at the body 2 and is pivotable about the vertical axis A. Pockets are attached to the inner side of the door 5 to form an additional storage area for refrigerated goods.

The unit 1 comprises four rollers 6, two front rollers and two rear rollers, at the bottom of the unit body 2, i.e. at the lower side of the base 4. These rollers 6 define the corner points of a rectangular footprint of the unit 1. The unit 1 can be pushed along the floor on the rollers 6 before its installation into the niche provided for this purpose. It can be recognized that the normal footprint does not extend up to the plane B of the opening toward the inner space 3 and by no means up to the front plane C of the closed door 5. There is therefore a risk that the unit 1 will tilt to the front on a comparatively small influence of force. This applies all the more on an unintended opening of the door. The width of the door 5 is within the same magnitude as the depth of the unit 1 and the door has a not insignificant weight due to the door pockets, the heat insulation, etc. The center of gravity of the unit 1 is therefore displaced on an opening of the door at least to close to the front edge of the footprint defined by the rollers 6.

Four adjustable feet 7, two front adjustable feet and two rear adjustable feet, are furthermore attached to the bottom of the unit body 2, i.e. to the lower side of the base 4, in addition to the rollers 6. All four adjustable feet 7 each have a platform 8 and a threaded bar 9 by which the platform 8 (cf. FIG. 2C) is connected to the body 2. The threaded bars 9 are received in bores at the body 2, with the bores having an internal thread such that the adjustable feet 7 can be moved in and out by a rotary movement.

The rollers 6 are preferably also vertically adjustable.

The adjustable feet 7 are retracted in the state of the unit 1 before the installation at the final installation site, i.e. in the state shown in FIG. 1A, so that a displacement of the unit 1 on the rollers 6 is not impeded. The adjustable feet 7 are only extended by rotation when the unit 1 is to be fixed at the installation site and replace the rollers 6 as floor-contacting parts. The footprint is thereby extended and the risk of tilting is reduced or removed. Depending on the situation, the unit 1 can additionally be fixed by an installation bracket, for example, at the installation location.

To prevent tilting of the unit 1 when the adjustable feet 7 have not yet been extended and the footprint of the unit 1 is defined by the rollers 6 (as in FIGS. 1A-1D), protection against tilting is provided in the form of two L-shaped section rails 10 that are clamped between the platforms 8 of the front adjustable feet 7 (in the installed state) and the bottom of the unit body 2 or of the base 4. To be able to clamp the rails 10 in a stable manner between the adjustable feet 7 and the bottom of the body 2, an elongated hole 12 open to the margin is provided at the rear side of the rails 10.

Figure 1B:
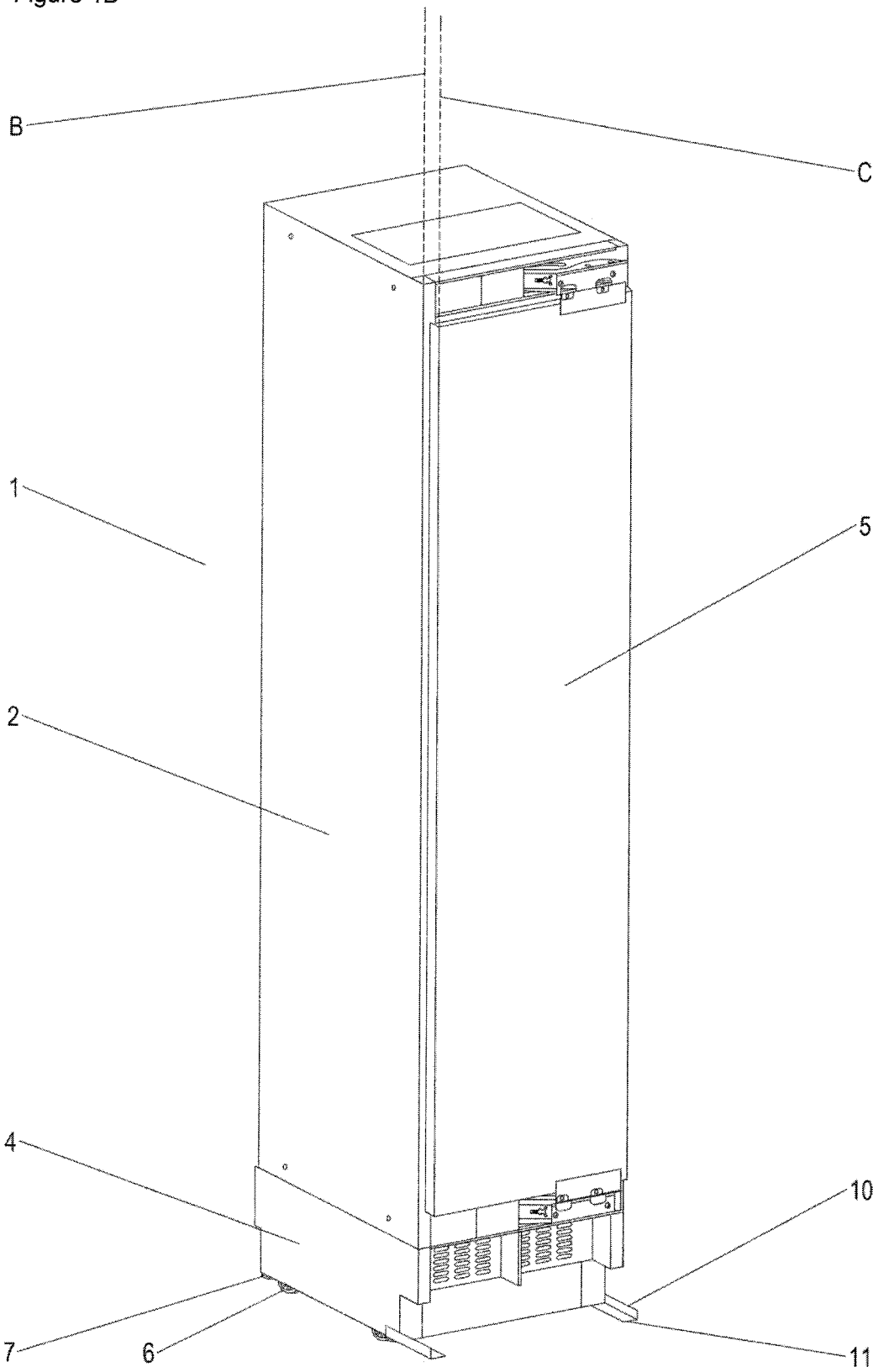
Figure 1C:
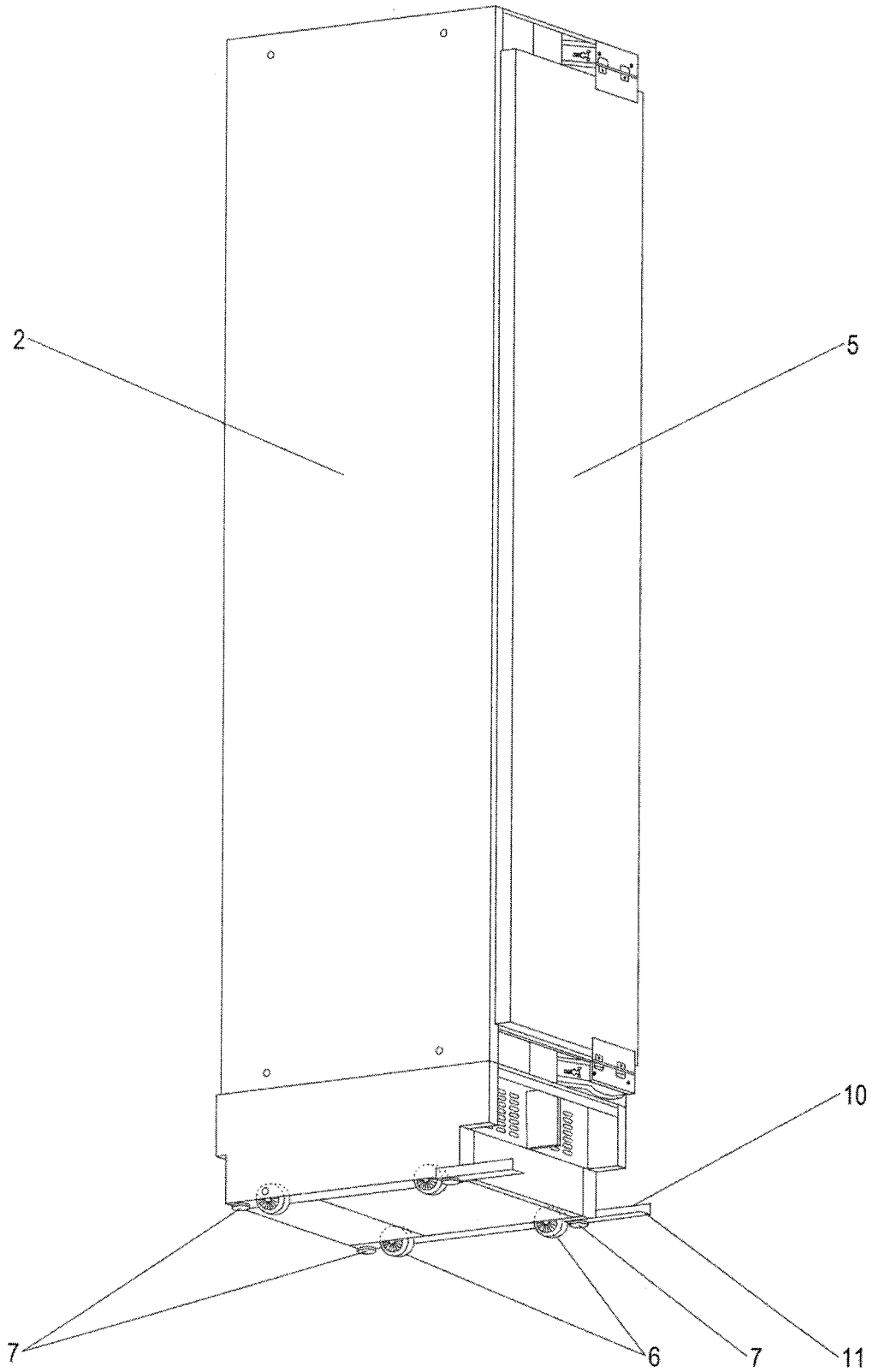
Figure 1D:
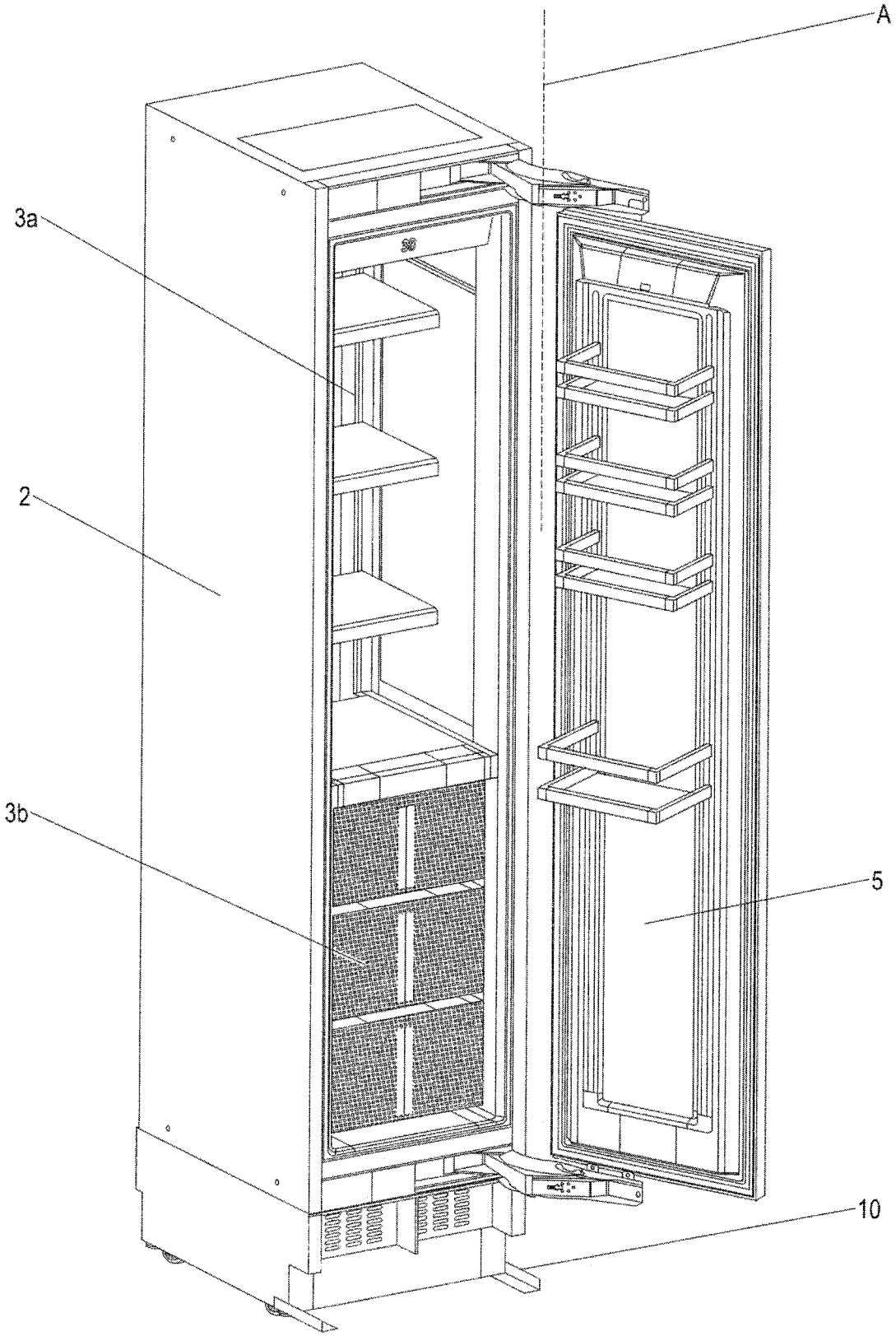
Figure 2A:
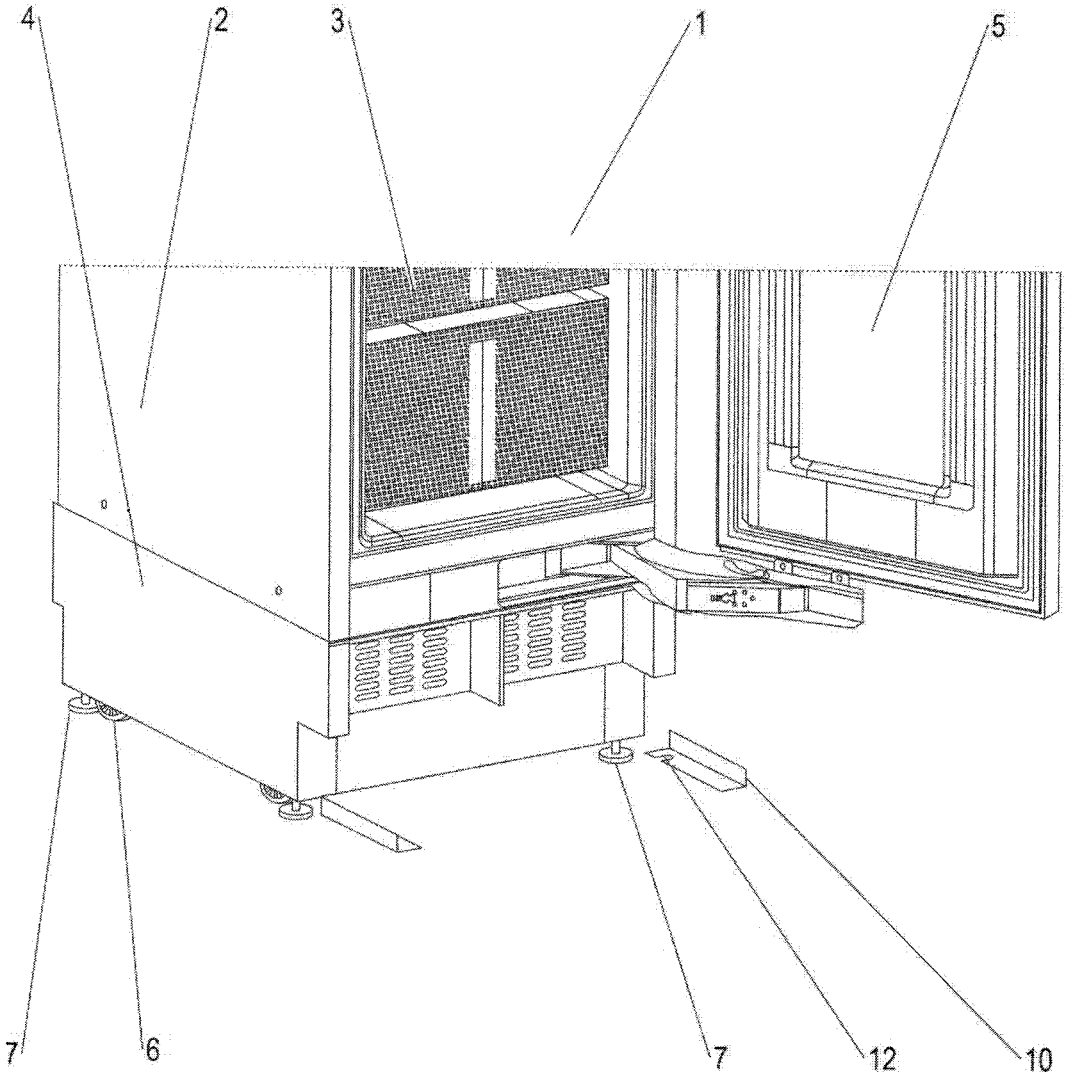
Figure 2B:
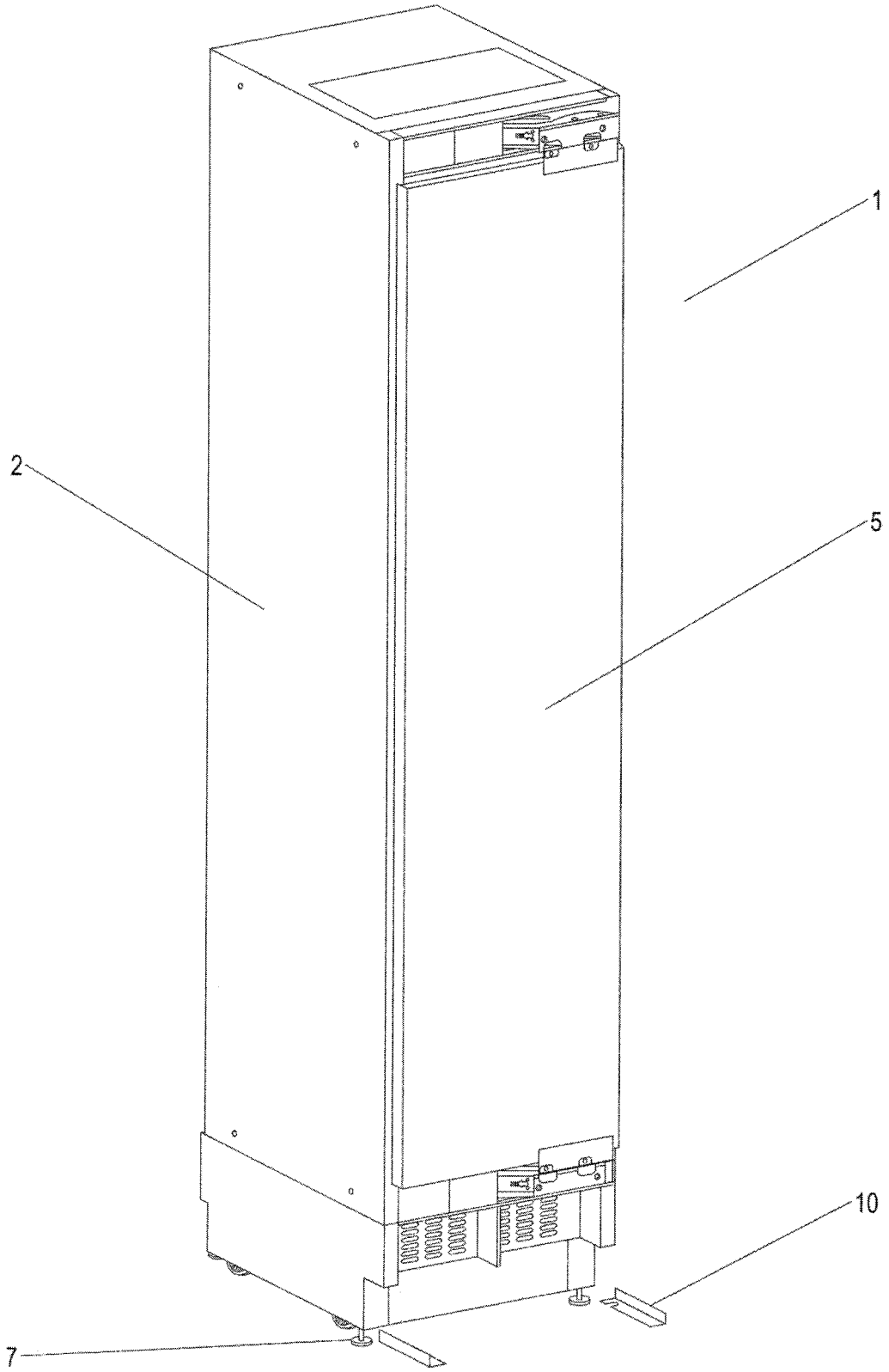
Figure 2C:
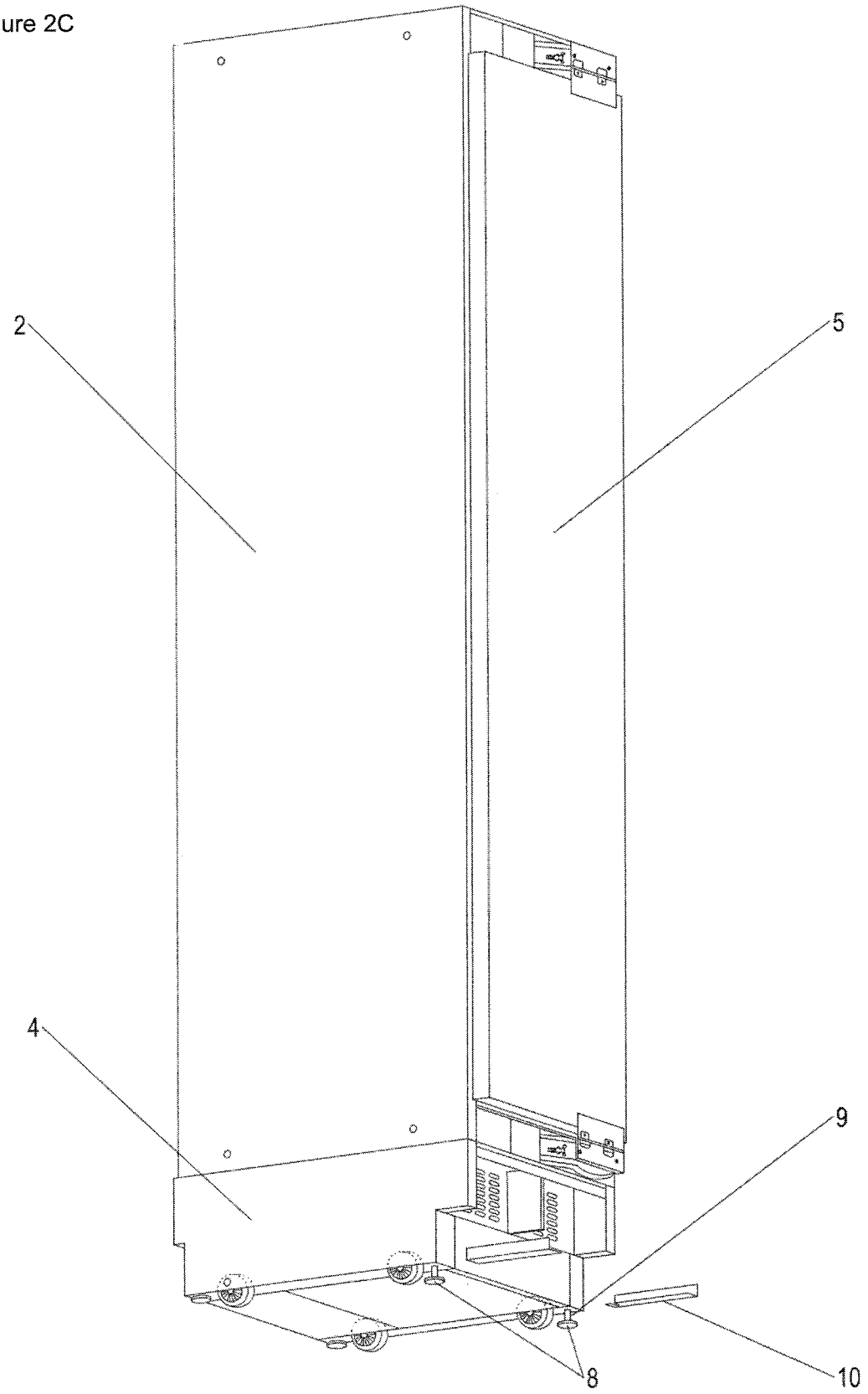
Figure 2D:
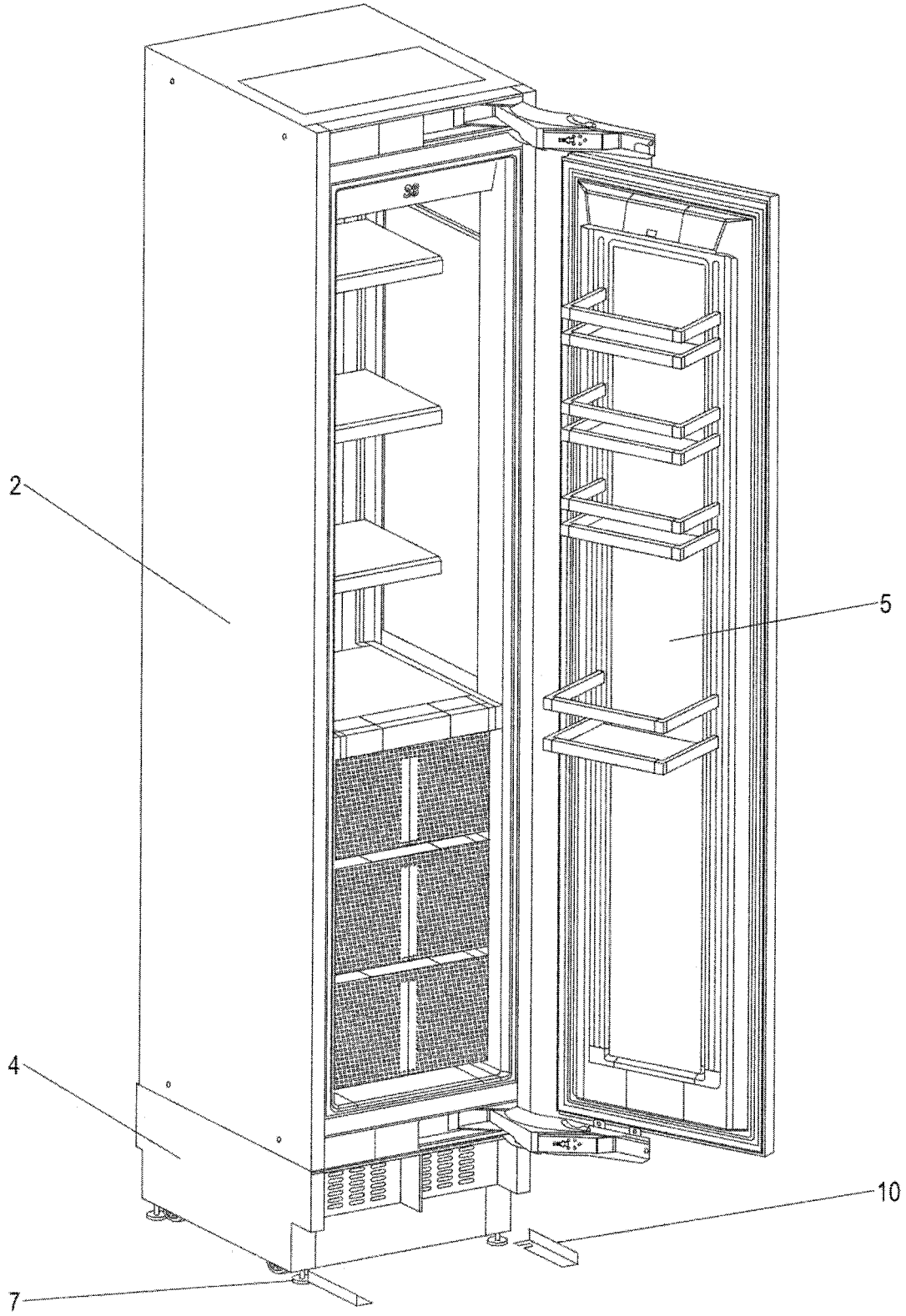

Starting from the front adjustable feet 7, the rails 10 extend to the front in a straight manner, with the end point 11 of the rails 10 being disposed in front of the plane B of the unit opening and approximately at the level of the frontal plane C of the closed door 5 (cf. FIG. 1B). The rails 10 are located at the level of the retracted adjustable feet 7 so that they do not contact the floor. A displacement of the unit 1 on the rollers 6 is thus not impeded. The rails 10 only extend close to the floor so that the tilt movement is immediately taken up by the rails 10 in the event of a tilting of the body 2 to the front, for example after an unintended door opening. The tilting point is thus displaced from the front rollers 6 to the front end 11 of the rails 10. The profiled L-shaped design of the rails 10 provides them with the required stability so that they do not bend on a tilting of the unit 1, but remain straight and can prevent a tilting over of the unit.

On the installation of the unit 1 at the final installation site and on the moving out of the adjustable feet 7, the clamping connection with the rails 10 is released, as is shown in FIGS. 2A-2D that show the unit in different perspectives. The rails can then simply be removed without a further workstep being required. In comparison with the state in FIGS. 1A-1D, the adjustable feet 7 are moved out, with the case being covered by the invention that all the adjustable feet having been moved or rotated outward by the same amount or also to different extents.

In the representations in accordance with FIGS. 1A-1D, the protection against tilting is secured, i.e. fixed, by a clamping connection with the adjustable feet 7. This is not the case in the arrangements in accordance with FIGS. 2A-2D. Since the adjustable feet 7 have been moved out, the clamping connection is dispensed with and the security against tilting or the rails can simply be removed.

The protection against tilting is preferably present ex works and up to the final installation at the customer's.

The protection against tilting is preferably only removed after the installation of the unit, e.g. into a kitchen niche, or after the securing of the unit by an installation bracket (wall, floor, . . . ).

The protection against tilting does not necessarily have to cooperate with the adjustable foot or feet.

It is also conceivable (alternatively or additionally) that the protection against tilting is arranged at the unit by means of a separate fastening, such as by a screw connection. It can also be pushed into the unit or into a holder at the unit.

An (additional) roller can be attached to the protection against tilting to protect the floor or a runner can be attached.

The protection against tilting can have an L section or any other desired shape.

The invention claimed is:

1. A refrigerator unit, which is a refrigerator, a freezer or a refrigerator-freezer combination, the refrigerator unit being a built-in refrigerator configured to be installed to a furniture niche, the refrigerator unit comprising: a unit body with a cooled inner space;

a unit door pivotable about an axis to close the cooled inner space at a front side of the unit body;

adjustable feet fixed to the bottom of the unit body, the adjustable feet having a platform for contact with a floor of the furniture niche on their low ends, the adjustable feet being movable between a retracted position and an extended position; and a tip guard configured to protect the unit body against tilting when not already installed in the furniture niche, the tip guard being attached to the unit body and extending beyond a front side tilting point of the unit body when not already installed in the furniture niche; wherein the tip guard is clamped between the platform of the adjustable feet and the bottom of the unit body in such way that the tip guard may not be removed from the unit body when the adjustable feet are in their retracted position and may be removed from the unit body when the adjustable feet are in their extended position; wherein the tip guard is removed from the refrigerator unit once the refrigerator unit is installed.

2. The refrigerator unit of claim 1, wherein the tip guard defines an extended footprint that extends beyond the normal footprint of the unit body on its front side.

3. A method of installing the refrigerator unit of claim 1, to a furniture niche, said method comprising:

fixing the refrigerator unit inside the furniture niche;

moving the adjustable feet from a retracted to an extended position to remove the tip guard.

4. The refrigerator unit of claim 1, wherein rollers are fixed to the bottom of the unit body, wherein the rollers extend beyond the adjustable feet when in a retracted position and thereby define a normal footprint of the unit body, and wherein the adjustable feet extend beyond the rollers when in an extended position, thereby enlarging the normal footprint of the unit body.

5. The refrigerator unit of claim 1, wherein the tip guard comprises separate parts for each side of the refrigerator.

6. The refrigerator unit of claim 5, wherein the separate parts of the tip guard are strip-shaped and extend horizontally from the adjustable feet.

* * * * *